US008248344B2

(12) United States Patent
Song

(10) Patent No.: US 8,248,344 B2
(45) Date of Patent: Aug. 21, 2012

(54) METHOD AND APPARATUS FOR DRIVING A LIQUID CRYSTAL DISPLAY PANEL IN A DOT INVERSION SYSTEM

(75) Inventor: Hong Sung Song, Kyoungsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 202 days.

(21) Appl. No.: 10/021,009

(22) Filed: Dec. 19, 2001

(65) Prior Publication Data

US 2002/0075212 A1 Jun. 20, 2002

(30) Foreign Application Priority Data

Dec. 20, 2000 (KR) ..... P2000-0079376

(51) Int. Cl.
*G09G 3/36* (2006.01)

(52) U.S. Cl. ..... 345/96; 345/94; 345/100

(58) Field of Classification Search ..... 345/87–101, 345/690

See application file for complete search history.

(56) References Cited

U.S. PATENT DOCUMENTS

| | | | | |
|---|---|---|---|---|
| 5,598,177 | A * | 1/1997 | Mizukata et al. | 345/92 |
| 5,648,793 | A * | 7/1997 | Chen | 345/96 |
| 5,825,343 | A * | 10/1998 | Moon | 345/94 |
| 5,867,141 | A * | 2/1999 | Asada et al. | 345/100 |
| 5,874,933 | A * | 2/1999 | Hirai et al. | 345/89 |
| 5,900,856 | A * | 5/1999 | Iino et al. | 345/100 |
| 6,072,451 | A * | 6/2000 | Mano et al. | 345/100 |
| 6,072,457 | A * | 6/2000 | Hashimoto et al. | 345/100 |
| 6,075,507 | A * | 6/2000 | Miyahara et al. | 345/89 |
| 6,266,039 | B1 | 7/2001 | Aoki | |
| 6,335,719 | B1 * | 1/2002 | An et al. | 345/98 |
| 6,359,608 | B1 * | 3/2002 | Lebrun et al. | 345/100 |
| 6,522,319 | B1 * | 2/2003 | Yamazaki | 345/103 |

FOREIGN PATENT DOCUMENTS

| | | | |
|---|---|---|---|
| JP | S62-055694 | | 3/1987 |
| JP | 01106017 | A * | 4/1989 |
| JP | 08-15671 | | 1/1996 |
| JP | 11-85115 | | 3/1999 |
| JP | H11-352938 | | 12/1999 |
| JP | 2001-356739 | | 12/2001 |
| JP | 2002-108288 | | 4/2002 |
| WO | WO99/04384 | | 1/1999 |

* cited by examiner

*Primary Examiner* — Joe H Cheng
(74) *Attorney, Agent, or Firm* — Morgan, Lewis & Bockius LLP

(57) ABSTRACT

A method of driving a liquid crystal display panel of a dot inversion system having liquid crystal cells arranged at intersections between a plurality of data lines and a plurality of gate lines in a matrix array, including supplying the data lines with (n−2)th data corresponding to the liquid crystal cells connected to an (n−2)th gate line, conducting a data supply channel for the liquid crystal cells connected to an nth gate line such that the (n−2)th data is supplied to the liquid crystal cells connected to the nth gate line, conducting a data supply channel for the liquid crystal cells connected to the nth gate line such that the (n−2)th data is supplied to the liquid crystal cells connected to the nth gate line, and conducting a data supplying channel for the liquid crystal cells connected to the (n−2)th gate line such that the (n−2)th data is supplied to the liquid crystal cells connected to the (n−2)th gate line, wherein conducting the data supply channel and conducting the data supplying channel are performed simultaneously.

3 Claims, 7 Drawing Sheets

METHOD AND APPARATUS FOR DRIVING A LIQUID CRYSTAL DISPLAY PANEL IN A DOT INVERSION SYSTEM

The present invention claims the benefit of Korean Patent Application No. P2000-79376 filed in Korea on Dec. 20, 2000, which is hereby incorporated by reference.

BACKGROUND OF THE INVENTION

1. Field of the Invention

The present invention relates to a liquid crystal display device, and more particularly to a method and apparatus for driving a liquid crystal display panel in a dot inversion system.

2. Description of the Related Art

In general, a liquid crystal display (LCD) controls light transmissivity of liquid crystal cells on a liquid crystal display panel, thereby displaying image data (a picture) that correspond to video signals.

FIG. 1 is a schematic block diagram showing a configuration of a conventional liquid crystal display panel driving apparatus employing a dot inversion system. In FIG. 1, a conventional LCD includes a liquid crystal display panel 3, a data driving integrated circuit (IC) 1 for applying a data signal to the liquid crystal display panel 3, and a gate driving IC 2 for applying a scanning signal to the liquid crystal display panel 3.

The liquid crystal display panel 3 is provided with a plurality of liquid crystal cells and thin film transistors (TFT's) for switching data signals to be applied to the liquid crystal cells. The plurality of liquid crystal cells and TFT's are arranged at intersections between a matrix array of data lines DL1 to DLp and gate lines GL1 to GLm.

The gate driving IC 2 includes multiple-stage shift registers for driving the gate lines GL1 to GLm, and responds to a gate start pulse GSP to sequentially drive the gate lines GL1 to GLm. FIG. 2 is a waveform diagram of a gate pulse applied to each of the data lines shown in FIG. 1. The gate driving IC 2 sequentially applies a gate driving pulse to the m-number of gate lines GL1 to GLm on the liquid crystal display panel 3 when the gate start pulse GSP is applied to the gate driving IC 2, thereby sequentially driving the gate lines GL1 to GLm. Accordingly, the TFT's of the liquid crystal display panel 3 are sequentially driven for each individual gate line to sequentially apply the data signals.

The data driving IC 1 includes shift registers and latches. The data driving IC 1 shifts data bits in response to a data shift clock DSC, and applies data to the data lines DL1 to DLp simultaneously in response to a data output enable signal DOE. If the data output enable signal DOE is applied to the data driving IC 1, then the data driving IC 1 applies p-number of data signals to the p-number of data lines DL1 to DLp whenever a gate driving pulse is generated. The n-number of data signals generated from the data driving IC 1 have alternating polarities in accordance with an arranged sequence of adjacent data lines. In addition, the p-number of data signals generated from the data driving IC 1 have alternating polarities converted with a lapse of frame.

FIGS. 3A and 3B depict polarities of liquid crystal cells employing a dot inversion system according to the conventional art. An LCD employs any one of line inversion, column inversion, and dot inversion systems to drive liquid crystal cells of the liquid crystal display panel. In a liquid crystal display panel driving method employing the dot inversion system, as shown in FIGS. 3A and 3B, adjacent liquid crystal cells on the gate lines and the adjacent liquid crystal cells on the data lines are supplied with data signals having opposing relative polarities, and the polarities of the data signals applied to all the liquid crystal cells of the liquid crystal display panel are inverted every frame. In other words, in the dot inversion system, when video signals at odd-numbered frames are displayed, data signals are applied to the liquid crystal cells of the liquid crystal display panel such that the positive (+) polarity and the negative (−) polarity alternate as the data signals are applied from the left upper liquid crystal cell to the right upper liquid crystal cells and to the lower liquid crystal cells, as shown in FIG. 3A. On the other hand, when video signals at even-numbered frames are displayed, the polarities of data signals applied to respective liquid crystal cells are inverted in a manner contrary to the odd-numbered frames, as shown in FIG. 3B.

FIG. 4 is a waveform diagram of a data signal and a gate pulse applied to a liquid crystal cell according to the conventional art. In FIG. 4, data signals having opposing polarities are applied to the liquid crystal cells at two continuous frames, as shown in FIG. 4. In FIG. 4, the third frame and the fourth frame during one horizontal synchronizing signal interval 1H at which a gate start pulse GSP is applied to the gate line GL receive data signals having opposing polarities.

As described above, the dot inversion system allows data signals having opposing relative polarities to be applied to adjacent liquid crystal cells in the vertical and horizontal directions, thereby providing an improved picture quality. Accordingly, the dot inversion system is conventional for driving a liquid crystal display panel.

FIG. 5 is a waveform diagram of a voltage applied to a liquid crystal cell according to the conventional art. In FIG. 5, a liquid crystal display panel that adopts the dot inversion system allows a first liquid crystal cell at two successive frames to be supplied with a gate start pulse GSP, and allows a data signal to be charged in the liquid crystal cell. Accordingly, a polarity-inverted data signal is charged in the liquid crystal cells at the two successive frames. For example, a positive (+) data signal is charged in the first liquid crystal cell at a third frame, whereas a negative (−) data signal is charged in the first liquid crystal cell at a fourth frame. In order to apply a data signal to the liquid crystal cell during a time 'c' at which a gate start pulse GSP is applied, a data signal is applied to charge the applied data signal into a liquid crystal cell. Accordingly, a switching time required for applying the data signal is 'a' and a charging time for charging the data signal into the liquid crystal cell is 'b'.

To enhance high resolution, it is necessary to provide a high-speed driving operation, thereby reducing a width of an applied gate pulse. Thus, a horizontal synchronizing signal interval is not only shortened, but also a time at which a data signal is applied to the liquid crystal cell is reduced. In other words, since a number of data signals required to be applied at a same time becomes larger as resolution increases, a time 'c' at which a gate pulse is applied is reduced. Furthermore, as a number of data signals to be applied to the liquid crystal cell increases, a switching time 'a' required for applying the data signals is increased. Thus, a charging time 'b' required for charging the data signals into the liquid crystal cell is shortened.

However, in the dot inversion system, if positive (+) data signals are applied to the liquid crystal cells at odd-numbered frames, negative (−) data signals are applied to the liquid crystal cells at even-numbered frames. Accordingly, a level for switching the data signal is increased since the data signals applied to the liquid crystal cells at two consecutive frames should be converted from the positive (+) polarity to the negative (−) polarity, thereby increasing the switching time 'a' of the data signal. As a result, since a time 'c' at which a gate pulse GP is applied is fixed for each resolution, and a switching time 'a' of the data signal is increased, a time 'b' at which the data signal is applied to the liquid crystal cell should be decreased. Accordingly, the data signal is not completely charged in the liquid crystal cell, thereby distorting color or brightness of the image.

SUMMARY OF THE INVENTION

Accordingly, the present invention is directed to a method and apparatus for driving a liquid crystal display panel in a dot conversion system that substantially obviates one or more of the problems due to limitations and disadvantages of the related art.

An object of the present invention is to provide a liquid crystal display panel driving method and apparatus employing a dot inversion system that is adaptive for realizing a high-resolution picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended claims.

To achieve these and other advantages and in accordance with the purpose of the present invention, as embodied and broadly described, a method of driving a liquid crystal display panel of a dot inversion system having liquid crystal cells arranged at intersections between a plurality of data lines and a plurality of gate lines in a matrix array, includes supplying the data lines with (n−2)th data corresponding to the liquid crystal cells connected to an (n−2)th gate line, conducting a data supply channel for the liquid crystal cells connected to an nth gate line such that the (n−2)th data is supplied to the liquid crystal cells connected to the nth gate line, conducting a data supply channel for the liquid crystal cells connected to the nth gate line such that the (n−2)th data is supplied to the liquid crystal cells connected to the nth gate line, and conducting a data supplying channel for the liquid crystal cells connected to the (n−2)th gate line such that the (n−2)th data is supplied to the liquid crystal cells connected to the (n−2)th gate line, wherein conducting the data supply channel and conducting the data supplying channel are performed simultaneously.

In another aspect, a driving apparatus for a liquid crystal display panel of dot inversion system having liquid crystal cells arranged at intersections between a plurality of data lines and a plurality of gate lines in a matrix array, includes a data driving integrated circuit supplying data to the data lines of the liquid crystal display panel, a gate driving integrated circuit responding to a gate start pulse to sequentially drive the gate lines of the liquid crystal display panel, and a pre-charging controller continuously generating first and second gate start pulses such that data corresponding to liquid crystal cells connected to an (n−2)th gate line is supplied to liquid crystal cell connected to an nth gate line, and applying the first and second gate start pulses to the gate driving integrated circuit.

In another aspect, a device for driving a liquid crystal display panel having a plurality of data lines, a plurality of gate lines orthogonal to the plurality of data lines, and a plurality of liquid crystal cells, includes a data driving integrated circuit supplying data to the data lines, a gate driving integrated circuit responding to a gate start pulse to drive the gate lines, and a pre-charging controller generating first and second gate start pulses to the gate driving integrated circuit, wherein data corresponding to liquid crystal cells connected to an (n−2)th gate line is supplied to liquid crystal cells connected to an nth gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are intended to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
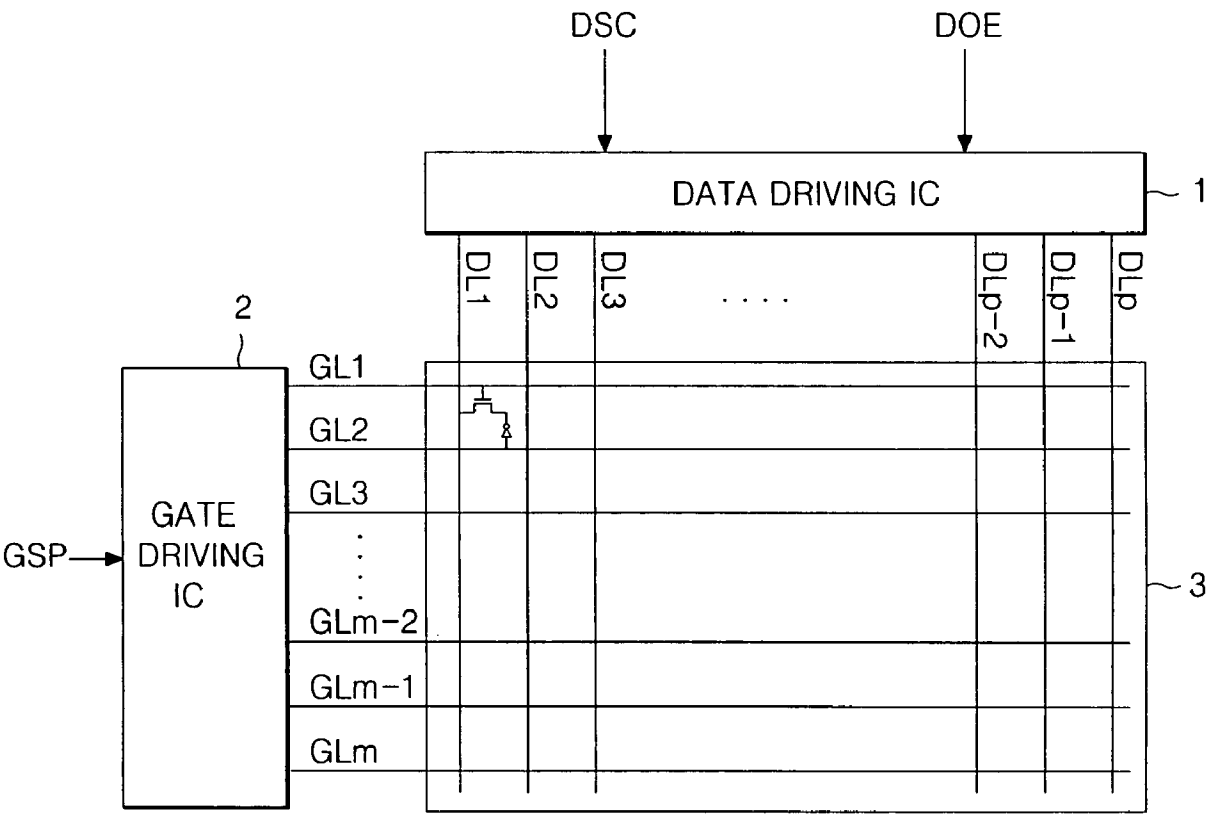
FIG. 1 RELATED ART
FIG. 1 is a schematic block diagram showing a configuration of a liquid crystal display panel driving apparatus employing a dot inversion system according to the conventional art.
Figure 2:
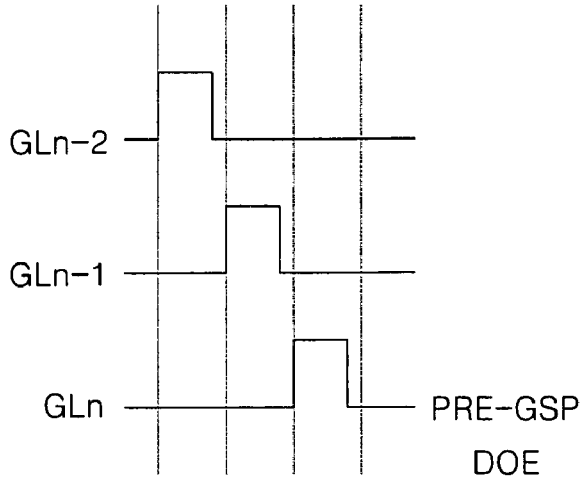
FIG.2 RELATED ART
FIG. 2 is a waveform diagram of a gate pulse applied to each of the data lines shown in FIG. 1 according to the conventional art.
Figure 4:
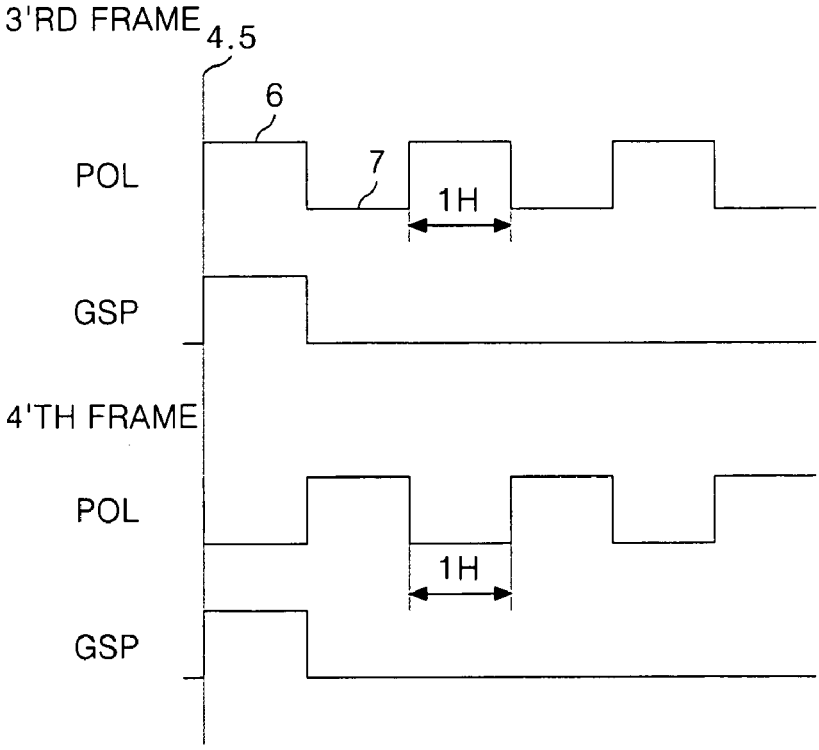
FIG.4 RELATED ART
FIG. 4 is a waveform diagram of a data signal and a gate pulse applied to a liquid crystal cell according to the conventional art.
Figure 3A:
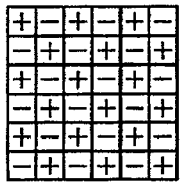
FIG.3A CONVENTIONAL ART
FIGS. 3A and 3B depict relative polarities of the liquid crystal cells employing the dot inversion system according to the conventional art.
Figure 3B:
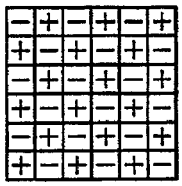
FIG.3B CONVENTIONAL ART
Figure 5:
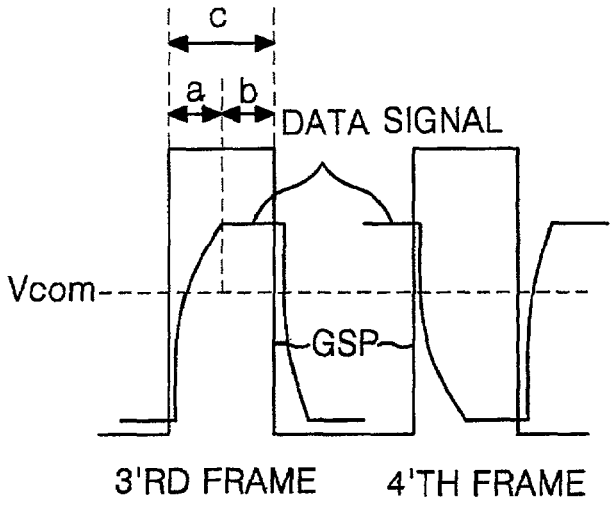
FIG.5 CONVENTIONAL ART
FIG. 5 is a waveform diagram of a voltage applied to a liquid crystal cell according to the conventional art.
Figure 6:
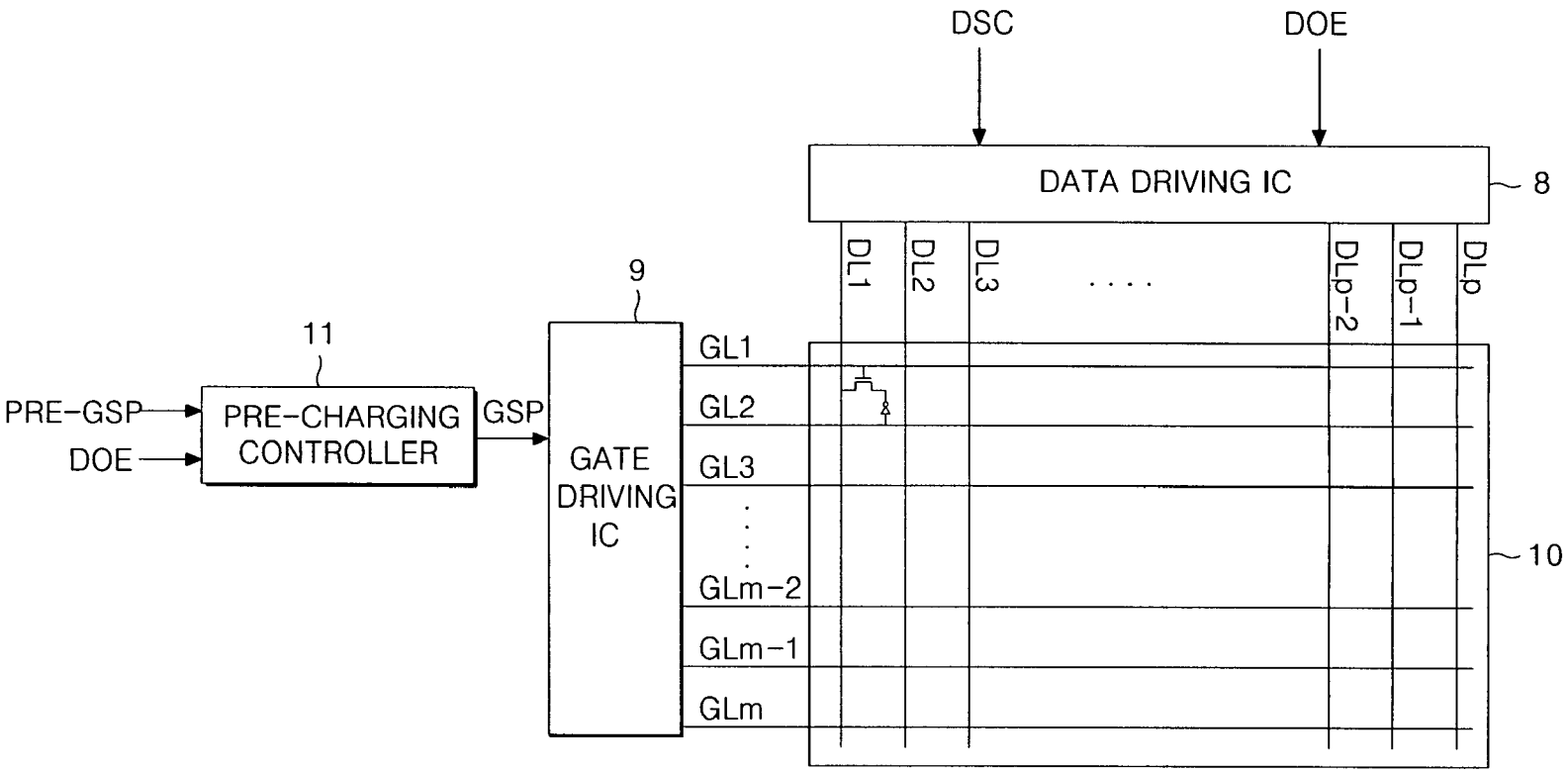
FIG. 6 is a schematic block diagram showing an exemplary configuration of a liquid crystal display driving apparatus according to the present invention.

FIG. 6 is a schematic block diagram showing an exemplary configuration of a liquid crystal display driving apparatus according to the present invention. In FIG. 6, a liquid crystal display panel driving apparatus includes a liquid crystal display panel 10, a data driving IC 8 for applying a data signal to the liquid crystal display panel 10, a gate driving IC 9 for applying a scanning signal to the liquid crystal display panel 10, and a pre-charging controller 11 for charging the data signal prior to inputting the data signal to a liquid crystal cell of the liquid crystal display panel 10.

The liquid crystal display panel 10 may be provided with a plurality of liquid crystal cells, and thin film transistors (TFT's) for switching the data signals that are applied to the liquid crystal cells. The plurality of liquid crystal cells and TFT's are arranged at intersections between data lines DL1 to DLp and gate lines GL1 to GLm in a matrix array.

The data driving IC 8 may include shift registers and latches. The data driving IC 8 shifts data bits in response to a data shift clock DSC, and applies data for the data lines DL1 to DLp simultaneously in response to a data output enable signal DOE.

The gate driving IC 9 may include multiple-stage shift registers for driving the gate lines GL1 to GLm. The gate driving IC 9 responds to first and second gate start pulses GSP from the pre-charging controller 11 to sequentially drive the gate lines GL1 to GLm.

The pre-charging controller 11 may continuously generate the first and second gate start pulses to supply liquid crystal cells connected to the nth gate line (n is an integer) with data corresponding to liquid crystal cells connected to the (n−2)th gate line. The pre-charging controller 11 may apply a pre-gate start pulse PRE-GSP to the gate driving IC 9 as a first gate start pulse GSP1 without any delay. Furthermore, the pre-charging gate controller 11 may delay the pre-gate start pulse PRE-GSP by a two-clock time period of a data output enable signal DOE to apply a second gate start pulse GSP2 following the first gate start pulse GSP1 to the gate driving IC 9.

Figure 7:
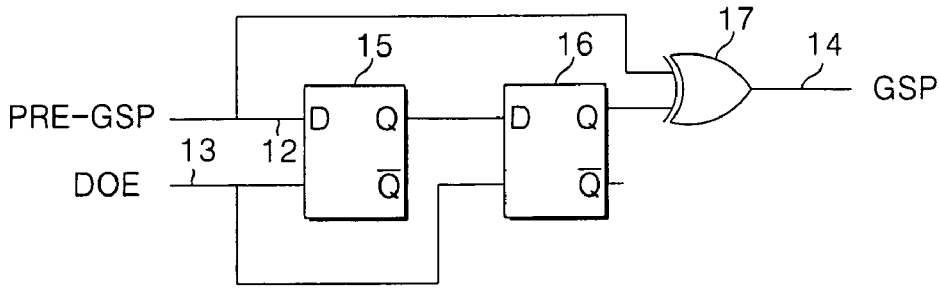
FIG. 7 is a detailed circuit diagram of an exemplary pre-charging gate controller shown in FIG. 6 according to the present invention.

FIG. 7 is a detailed circuit diagram of an exemplary pre-charging gate controller shown in FIG. 6 according to the present invention In FIG. 7, the pre-charging gate controller 11 may include first and second D flip-flops 15 and 16 connected, in series, between a pre-gate start pulse PRE-GSP input line 12 and a gate start pulse GSP output line 14, and an exclusive OR (XOR) gate 17. The pre-gate start pulse PRE-GSP may be simultaneously applied to a first input terminal of the XOR gate 17 and to an input terminal D of the first D flip-flop 15.

The first D flip-flop 15 delays the pre-gate start pulse PRE-GSP from the first input line 12 until the data output enable clock DOE is inputted from the second input line 13, and applies the pre-gate start pulse PRE-GSP to the second D flip-flop 16. The second D flip-flop 16 delays the pre-gate start pulse PRE-GSP received from the first D flip-flop 15 until a data output enable clock DOE is inputted, and applies the pre-gate start pulse PRE-GSP to a second input terminal of the XOR gate 17.

The XOR gate 17 executes an exclusive logical sum operation of signals applied to the first and second input lines 12 and 13, and applies the summed signal to the gate driving IC 9. As a result, the XOR gate 17 generates first and second gate start pulses GSP1 and GSP2 successively with intervening two data enable clock time periods, and applies the first and second gate start pulses GSP1 and GSP2 to the gate driving IC 9.

Figure 8:
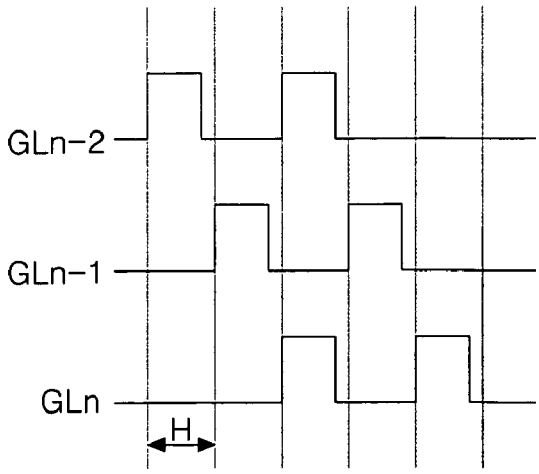
FIG. 8 is an exemplary waveform diagram of a gate pulse signal applied to each of the data lines shown in FIG. 7 according to the present invention.
Figure 9:
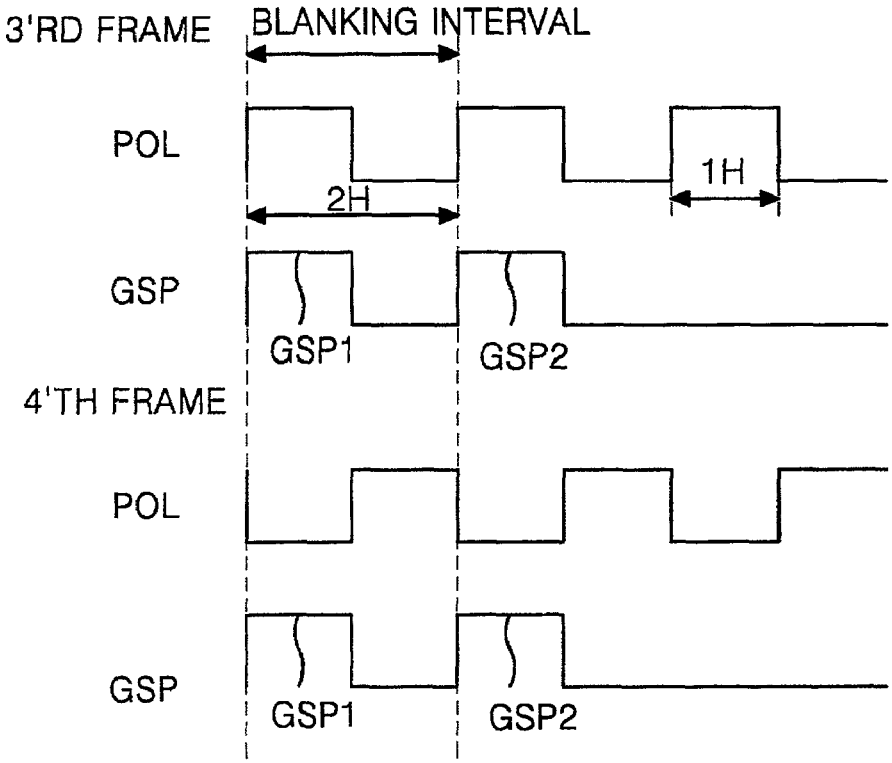
FIG. 9 is an exemplary waveform diagram of polarity pulses and gate start pulse signals of the data signals applied to the liquid crystal cells of the detailed circuit diagram shown in FIG. 7 according to the present invention.

FIG. 8 is an exemplary waveform diagram of a gate pulse signal applied to each of the data lines shown in FIG. 7, and FIG. 9 is an exemplary waveform diagram of polarity pulses and gate start pulse signals of the data signals applied to the liquid crystal cells of the detailed circuit diagram shown in FIG. 7 according to the present invention. In FIGS. 8 and 9, if the first gate start pulse GSP1 is inputted to the gate driving IC 9, then a gate high pulse is sequentially applied to the gate lines GL1 to GLm. Subsequently, after a two-line time period, the second gate start pulse GSP2 is applied to the gate driving IC 9. Then, two gate high pulses are continuously applied to each gate line with an intervening two-line time period. A gate high pulse applied primarily to the nth gate line is synchronized with a gate high pulse applied secondarily to the (n−2)th gate line. Data corresponding to the (n−2)th gate line is simultaneously applied to liquid crystal cells connected to the (n−2)th gate line and to liquid crystal cells connected to the nth gate line. The liquid crystal cells connected to the (n−2)th gate line and to the nth gate line are charged with data having a same polarity. Accordingly, the data applied to the liquid crystal cells connected to the (n−2)th gate line and to the nth gate line have opposite relative polarities such that adjacent liquid crystal cells in the horizontal direction are charged at mutually opposing polarities.

Likewise, a gate high pulse applied primarily to the (n+1)th gate line is synchronized with a gate high pulse applied secondarily to the (n−1)th gate line. Data signals corresponding to the (n−1)th gate line are simultaneously applied to liquid crystal cells connected to the (n−1)th gate line and liquid crystal cells connected to the (n+1)th gate line. As a result, the liquid crystal cells connected to the (n−1)th gate line and the (n+1)th gate line are charged with data signals having a same polarity. Furthermore, the liquid crystal cells connected to the (n−1)th gate line and the (n+1)th gate line are charged at mutually opposing polarities between adjacent liquid crystal cells in the horizontal direction, and the liquid crystal cells connected to the (n−2)th gate line and the nth gate line are charged at mutually opposing polarities in the vertical direction.

If the gate high pulses are continuously applied to the gate lines GL1 to GLm with an intervening two data enable clock time period, data signals corresponding to a certain (n−2)th gate line are simultaneously applied to the liquid crystal cells connected to the (n−2)th gate line and to the liquid crystal cells connected to the nth gate line. Accordingly, data signals are charged in the liquid crystal cells at a previous frame in advance so that the data signals to be charged in the liquid crystal cells at a current frame can be charged at an increased speed.

Figure 10:
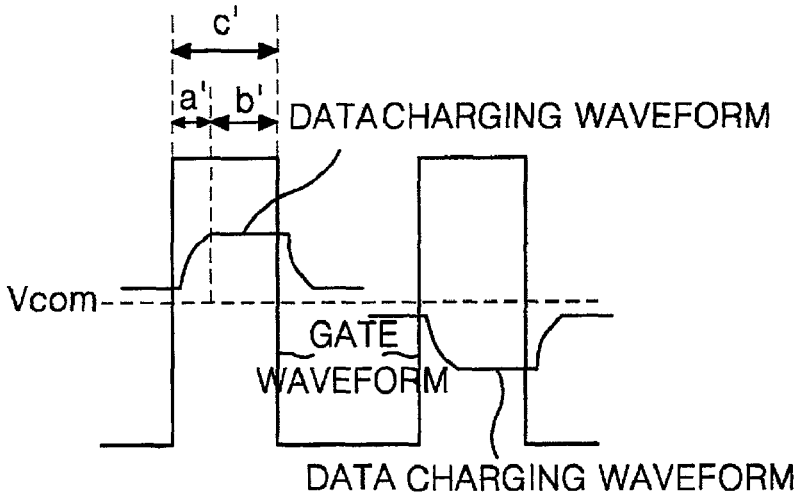
FIG. 10 is another exemplary waveform diagram of a voltage applied to a liquid crystal cell according to the present invention.

FIG. 10 is another exemplary waveform diagram of a voltage applied to a liquid crystal cell according to the present invention. In FIG. 10, a time c' at which a gate pulse is applied is fixed for each resolution of a picture, and a data signal is charged in the liquid crystal cell in advance, thereby reducing a switching time a' of the data signal required for applying the data signal. Accordingly, a time b' at which a data signal is really applied to the liquid crystal cell is increased, so that a time c' at which a gate pulse is applied can be reduced. Accordingly, a large number of data signals can be applied to the liquid crystal cells, thereby realizing higher resolution.

In FIG. 9, the liquid crystal cells connected to first and second gate lines of the liquid crystal display panel are supplied with active data signals after they was charged in advance with data signals at a blanking interval. The polarity inversion of the active data signals applied to the liquid crystal cells should be made prior to at least two clock intervals 2H from an application time of the active data signals. In addition, control signals for controlling the gate driving IC and the data driving IC that are required for charging the data signals should be applied prior to at least two clock intervals 2H.

According to the present invention, data corresponding to a certain (n−2)th gate line are simultaneously supplied to the liquid crystal cells connected to the (n−2)th gate line, and to the liquid crystal cells connected to the nth gate line. Accordingly, the data signals can be charged, in advance, in the liquid crystal cells at a previous frame and a time required for loading the data signals can be reduced. As a result, a time required for applying data signals can be lengthened even though a large number of data signals must be applied to the liquid crystal cells, thereby realizing a high-resolution picture.

It will be apparent to those skilled in the art that various modifications and variations can be made in the method and apparatus for driving a liquid crystal display panel in a dot conversion system of the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display panel of a dot inversion system having liquid crystal cells arranged at intersections between a plurality of data lines and a plurality of gate lines in a matrix array, the method comprising:

supplying the data lines with (n-2)th data corresponding to the liquid crystal cells connected to an (n-2)th gate line, wherein n is an integer greater than 2;

supplying a first gate start pulse;

in response to the first gate start pulse, generating a first gate high pulse;

in response to the first gate high pulse, conducting a first data supplying channel for the liquid crystal cells connected to an nth gate line such that the (n-2)th data is supplied to the liquid crystal cells connected to the nth gate line;

supplying a second gate start pulse;

in response to the second gate start pulse, generating a second gate high pulse;

in response to the second gate high pulse, conducting a second data supplying channel for the liquid crystal cells connected to the (n-2)th gate line such that the (n-2)th data is supplied to the liquid crystal cells connected to the (n-2)th gate line, wherein a duration of the first gate high pulse is smaller than a duration of the first gate start pulse;

wherein a duration of the second gate high pulse is smaller than a duration of the second gate start pulse;

wherein conducting the first data supplying channel and conducting the second data supplying channel are performed substantially simultaneously, wherein the first and second gate start pulses are output from a pre-charging controller;

wherein the pre-charging controller includes;

a first input line supplied with a pre-gate start pulse and a second input line supplied with a data output enable signal (DOE) for controlling data output of a data driving integrated circuit, wherein the data driving integrated circuit applies data to the data lines in response to the data output enable signal, and wherein the data output enable signal is directly applied to the data driving integrated circuit and the pre-charging controller;

first delay means for delaying the pre-gate start pulse from the first input line by one clock interval of the data output enable signal in response to the data output enable signal;

second delay means for delaying the delayed pre-gate start pulse from the first delay means by one clock interval of the data output enable signal in response to the data output enable signal; and a gate device for executing an exclusive logical sum operation of the pre-gate start pulse from the first input line and an output signal of the second delay means to continuously output the first and second gate start pulses;

wherein the liquid crystal cells connected to first and second gate lines of the plurality of gate lines are supplied with an active data signal after the liquid crystal cells connected to the first and second gate lines were charged in advance with a data signal at every frame with a data signal applied at a blanking interval;

wherein the duration of the first gate high pulse is smaller than one clock interval;

wherein the duration of the second gate high pulse is smaller than one clock interval;

wherein the duration of the first gate high pulse consists of a first time during which a data signal is applied and a first switching time;

wherein the duration of the second gate high pulse consists of a second time during which a data signal is applied and a second switching time;

wherein the first time during which the data signal is applied is greater than the first switching time;

wherein the second time during which the data signal is applied is greater than the second switching time;

wherein polarity inversion of the data signals applied to the liquid crystal cells connected to the first and second gate lines is made in at least two clock time intervals prior to an application of the active data signal;

wherein gate and data control signals for applying data to the liquid crystal cells connected to the first and second gate lines are applied in at least two clock time intervals before the gate and data control signals become effective data.

2. A driving apparatus for a liquid crystal display panel of dot inversion system having liquid crystal cells arranged at intersections between a plurality of data lines and a plurality of gate lines in a matrix array, the apparatus comprising:

a data driving integrated circuit supplying data to the data lines of the liquid crystal display panel in response to a data output enable signal (DOE);

a gate driving integrated circuit responsive to first and second gate start pulses to sequentially generate first and second gate high pulses so as to drive the gate lines of the liquid crystal display panel;

a pre-charging controller to generate the first and second gate start pulses to supply an (n-2)th data corresponding to liquid crystal cells connected to an (n-2)th gate line to both liquid crystal cells connected to an nth gate line and liquid crystal cells connected to the (n-2)th gate line, wherein n is an integer greater than 2;

wherein a duration of the first gate high pulse is smaller than a duration of the first gate start pulse;

wherein a duration of the second gate high pulse is smaller than a duration of the second gate start pulse;

wherein the pre-charging controller includes;

a first input line supplied with a pre-gate start pulse and a second input line supplied with the data output enable signal for controlling data output of the data driving integrated circuit;

first delay means for delaying the pre-gate start pulse from the first input line by one clock interval of the data output enable signal in response to the data output enable signal;

second delay means for delaying the delayed pre-gate start pulse from the first delay means by one clock interval of the data output enable signal in response to a data output enable signal; and a gate device for executing an exclusive logical sum operation of the pre-gate start pulse from the first input line and an output signal of the second delay means to continuously output the first and second gate start pulses;

wherein the liquid crystal cells connected to first and second gate lines of the plurality of gate lines are supplied with an active data signal after the liquid crystal cells connected to the first and second gate lines were charged in advance with a data signal at every frame with a data signal applied at a blanking interval;

wherein the duration of the first gate high pulse is smaller than one clock interval;

wherein the duration of the second gate high pulse is smaller than one clock interval;

wherein the duration of the first gate high pulse consists of a first time during which a data signal is applied and a first switching time;

wherein the duration of the second gate high pulse consists of a second time during which a data signal is applied and a second switching time;

wherein the first time during which the data signal is applied is greater than the first switching time;

wherein the second time during which the data signal is applied is greater than the second switching time;

wherein the data output enable signal is directly applied to the data driving integrated circuit and the pre-charging controller;

wherein polarity inversion of the data signals applied to the liquid crystal cells connected to the first and second gate lines is made in at least two clock time intervals prior to an application of the active data signal;

wherein gate and data control signals for applying data to the liquid crystal cells connected to the first and second gate lines are applied in at least two clock time intervals before the gate and data control signals become effective data.

3. A device for driving a liquid crystal display panel having a plurality of data lines, a plurality of gate lines orthogonal to the plurality of data lines, and a plurality of liquid crystal cells, the device comprising:

a data driving integrated circuit supplying data to the data lines in response to a data output enable signal (DOE);

a gate driving integrated circuit responsive to first and second gate start pulses to generate first and second gate high pulses so as to drive the gate lines;

a pre-charging controller to generate the first and second gate start pulses to the gate driving integrated circuit, wherein an (n-2)th data corresponding to liquid crystal cells connected to an (n-2)th gate line is supplied to both liquid crystal cells connected to an nth gate line and liquid crystal cells connected to the (n-2)th gate line, wherein n is an integer greater than or equal to 2;

wherein a duration of the first gate high pulse is smaller than a duration of the first gate start pulse;

wherein a duration of the second gate high pulse is smaller than a duration of the second gate start pulse;

wherein the pre-charging controller;

a first input line supplied with a pre-gate start pulse and a second input line supplied with data output enable signal for controlling data output of the data driving integrated circuit;

first delay means for delaying the pre-gate start pulse from the first input line by one clock interval of the data output enable signal in response to the data output enable signal;

second delay means for delaying the delayed pre-gate start pulse from the first delay means by one clock interval of the data output enable signal in response to a data output enable signal; and a gate device for executing an exclusive logical sum operation of the pre-gate start pulse from the first input line and an output signal of the second delay means to continuously output the first and second gate start pulses;

wherein the liquid crystal cells connected to first and second gate lines of the plurality of gate lines are supplied with an active data signal after the liquid crystal cells connected to the first and second gate lines were charged in advance with a data signal at every frame with a data signal applied at a blanking interval;

wherein the duration of the first gate high pulse is smaller than one horizontal synchronizing signal interval;

wherein the duration of the second gate high pulse is smaller than one horizontal synchronizing signal interval;

wherein the distance between the first gate high pulse and the second gate high pulse is greater than the one horizontal synchronizing signal interval;

wherein the duration of the first gate high pulse consists of a first time during which a data signal is applied and a first switching time;

wherein the duration of the second gate high pulse consists of a second time during which a data signal is applied and a second switching time;

wherein the first time during which the data signal is applied is greater than the first switching time;

wherein the second time during which the data signal is applied is greater than the second switching time;

wherein the data output enable signal is directly applied to the data driving integrated circuit and the pre-charging controller;

wherein polarity inversion of the data signals applied to the liquid crystal cells connected to the first and second gate lines is made in at least two clock time intervals prior to an application of the active data signal;

wherein gate and data control signals for applying data to the liquid crystal cells connected to the first and second gate lines are applied in at least two clock time intervals before the gate and data control signals become effective data.

* * * * *